US008156885B1

(12) United States Patent
Beach

(10) Patent No.: US 8,156,885 B1
(45) Date of Patent: Apr. 17, 2012

(54) EMERGENCY CAPSIZED BOAT SEATING APPARATUS

(76) Inventor: Vannessa A. Beach, Indianapolis, IN (US)

( * ) Notice: Subject to any disclaimer, the term of this patent is extended or adjusted under 35 U.S.C. 154(b) by 0 days.

(21) Appl. No.: 12/913,442

(22) Filed: Oct. 27, 2010

(51) Int. Cl.
*B63B 25/00* (2006.01)

(52) U.S. Cl. ..... 114/363; 114/348

(58) Field of Classification Search ..... 114/348, 114/363
See application file for complete search history.

(56) References Cited

U.S. PATENT DOCUMENTS

| | | | | |
|---|---|---|---|---|
| 1,408,580 | A * | 3/1922 | Gaskin | 114/348 |
| 3,906,370 | A | 9/1975 | Apps | |
| 4,101,894 | A | 7/1978 | Warner et al. | |
| 4,102,296 | A | 7/1978 | Felix | |
| 4,700,648 | A * | 10/1987 | Trefethern et al. | 114/61.24 |
| 5,199,374 | A | 4/1993 | Blanchette | |
| D400,614 | S | 11/1998 | Henthorn | |
| 5,877,707 | A | 3/1999 | Kowalick | |
| 2007/0007805 | A1 | 1/2007 | Garelick | |
| 2009/0295603 | A1 * | 12/2009 | Clark et al. | 340/984 |

* cited by examiner

*Primary Examiner* — Edwin Swinehart

(57) ABSTRACT

A emergency capsized boat seating apparatus includes a boat that has a hull with a bottom side. A plurality of chair assemblies is provided and each is embedded into the bottom side. Each of the chair assemblies is positionable in a stored position is approximately flush with the bottom side or in a deployed position extending outwardly away from the bottom side.

12 Claims, 3 Drawing Sheets

EMERGENCY CAPSIZED BOAT SEATING APPARATUS

BACKGROUND OF THE DISCLOSURE

Field of the Disclosure

The disclosure relates to boat emergency seat devices and more particularly pertains to a new boat emergency seat device for providing seating on a capsized boat.

SUMMARY OF THE DISCLOSURE

An embodiment of the disclosure meets the needs presented above by generally comprising a boat that has a hull with a bottom side. A plurality of chair assemblies is provided and each is embedded into the bottom side. Each of the chair assemblies is positionable in a stored position is approximately flush with the bottom side or in a deployed position extending outwardly away from the bottom side.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
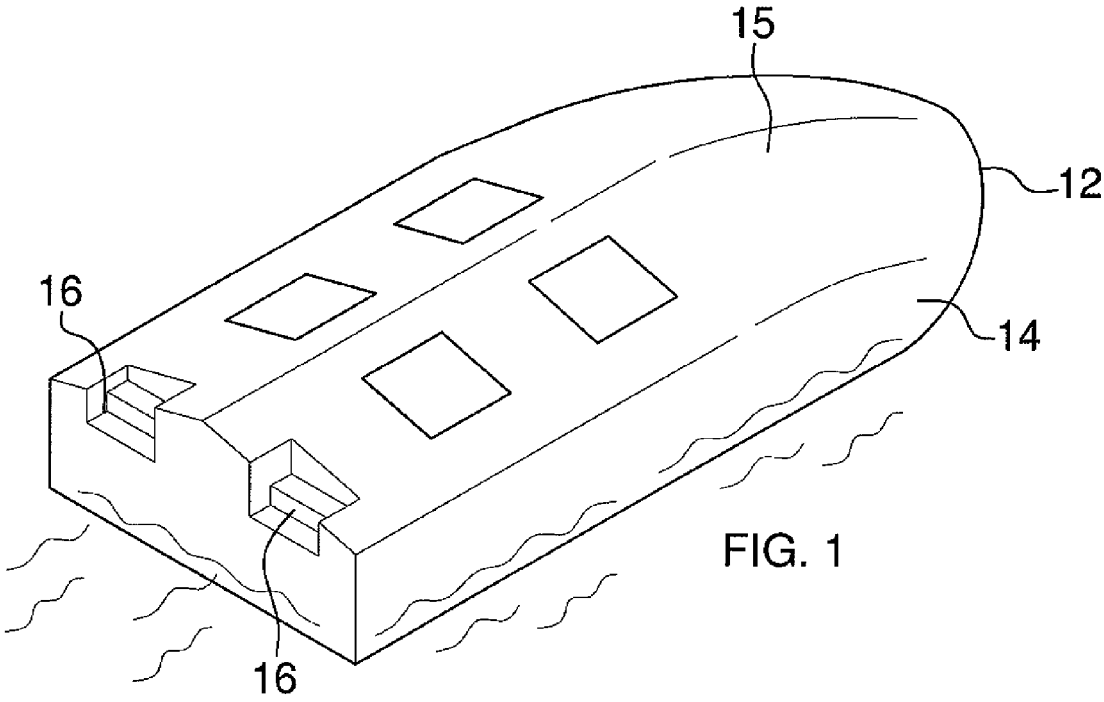
FIG. 1 is a bottom perspective view of a emergency capsized boat seating apparatus according to an embodiment of the disclosure.
Figure 2:
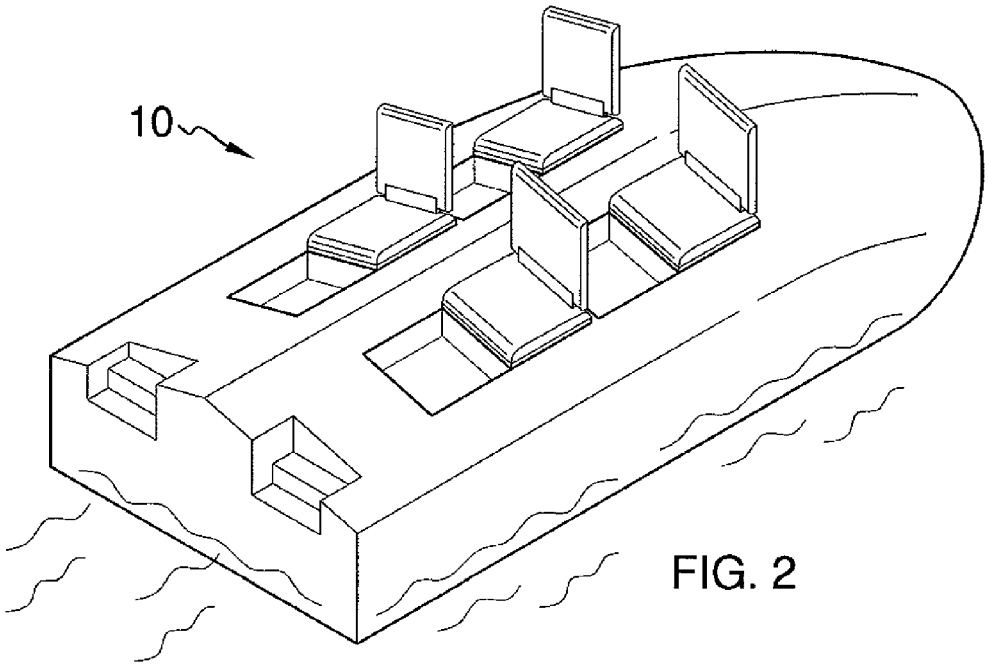
FIG. 2 is a bottom perspective view of an embodiment of the disclosure.

With reference now to the drawings, and in particular to FIGS. 1 through 5 thereof, a new boat emergency seat device embodying the principles and concepts of an embodiment of the disclosure and generally designated by the reference numeral 10 will be described.

As best illustrated in FIGS. 1 through 5, the emergency capsized boat seating apparatus 10 generally comprises a conventional boat 12 having a hull 14 with a bottom side 15. The hull 14 may include steps 16 configured to be used when the boat 12 is capsized.

A plurality of chair assemblies 18 is provided. Each of the chair members 18 is embedded into the bottom side 16. The chair assemblies 18 are each positionable in a stored position approximately flush with the bottom side 15 or in a deployed position extending outwardly away from the bottom side 15. The chair assemblies 18 may be moved to a deployed position either manually or by mechanical means. Only shown here are manually operated chair assemblies 18 as movement of the chair assemblies 18 to the deployed position may be achieved by any number of conventional structures.

Each of the chair assemblies 18 includes a chamber 20 extending into the bottom side 15. The chamber 20 includes a bottom wall 22 and a perimeter wall 24 that is attached to and extends between the bottom wall 22 and the bottom side 15 of the hull 14. A seat 26 is mounted to the hull 14. The seat 26 has an upper side 28, a lower side 30, a front edge 32 and a back edge 34. A juncture of the front edge 32 and the lower side 28 may be hingedly coupled to the hull 14 at a juncture of the perimeter wall 24 and the bottom side 15 to allow the seat 26 to be pivoted onto the bottom side 15 of the hull 14 such that the upper side 28 faces upwardly.

Figure 3:
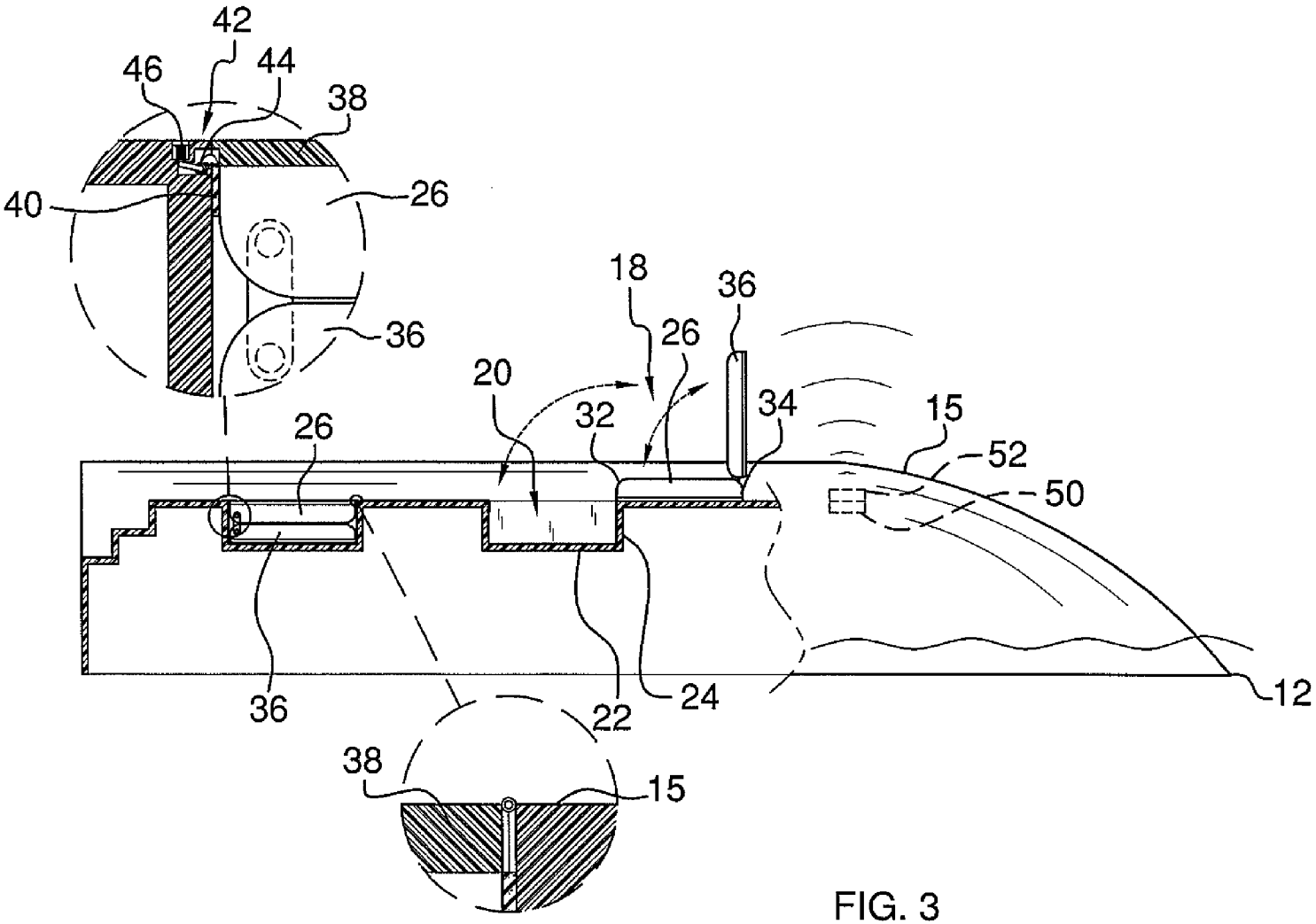
FIG. 3 is a side broken view of an embodiment of the disclosure.

The seat assembles 18 each further include a backrest 36 is pivotally coupled to the seat 26 adjacent to the back edge 34. The backrest 36 is foldable into the stored position lying on and abutting the upper side 28 or into the deployed position extending upwardly from the seat 26. The lower side 30 may comprise a cover 38 that covers the chamber 20 when the seat 26 is pivoted into the chamber 20. A gasket 40 may engage the cover 38 to inhibit water flow into the chamber 20. FIG. 3 depicts one locking mechanism 42 which may be used to manually lock the chair assemblies 18 in the stored position utilizing a lever 44 engaging the cover 38 which releases the cover 38 when an actuator 46 is depressed.

Figure 4:
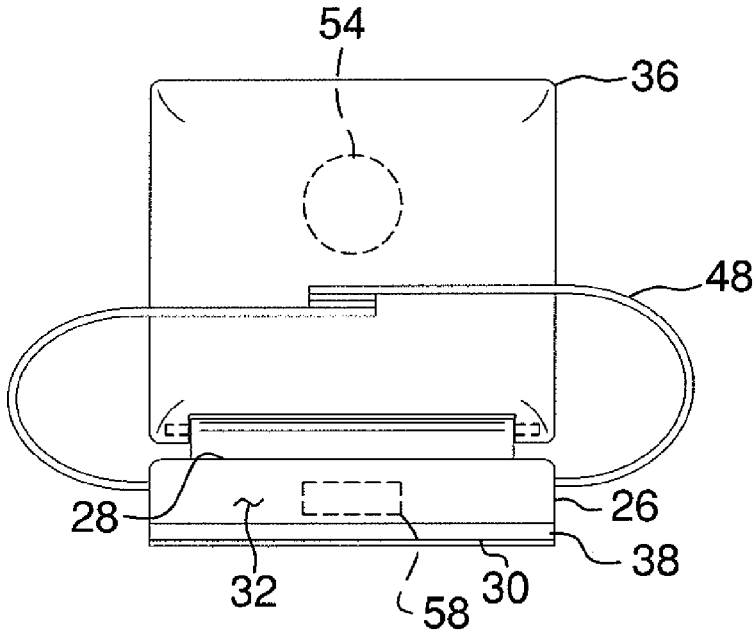
FIG. 4 is a front view of a chair assembly an embodiment of the disclosure.
Figure 5:
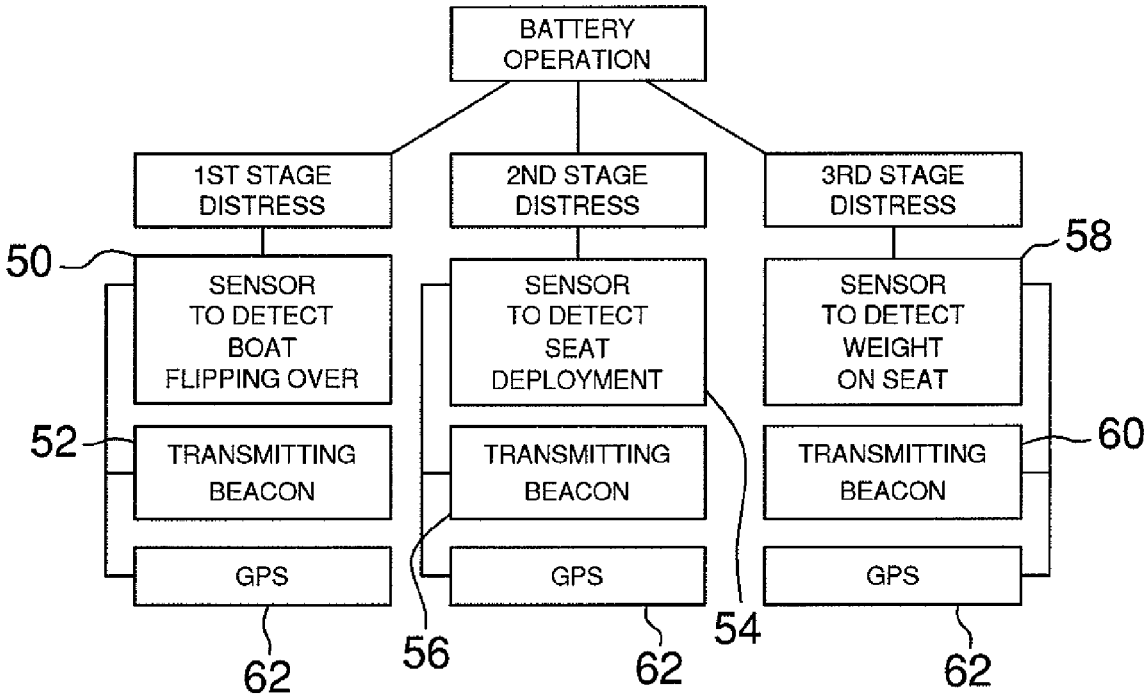
FIG. 5 is a schematic view of an embodiment of the disclosure.

As shown in FIG. 4, a plurality of seat straps 48 may be provided. Each of the chair assemblies 18 has one of the seat straps 48 attached thereto and is configured to secure a person to associated ones of the chair assemblies 18. The straps may utilize buckles or a hook and loop coupler 49 to secure together sections of the straps 48.

A capsized sensor 50 may be mounted in the boat 12. The capsized sensor 50 detects an orientation of the boat hull 14. A capsized beacon 52 is electrically coupled to the capsized sensor 50. The capsized beacon 52 wirelessly transmits a distress signal when the capsized sensor 50 detects the bottom side 15 facing upwardly.

A seat deployment sensor 54 may be mounted in one of the chair assemblies 18. A seat deployment beacon 56 is electrically coupled to the seat deployment sensor 54 and transmits a wireless distress signal when the seat deployment sensor 54 detects deployment of one of the chair assemblies 18 associated with the seat deployment sensor 54. Each of the chair assemblies 18 may include a seat deployment sensor 54 each electrically coupled to the seat deployment beacon 56.

A seat usage sensor 58 may be mounted in one of the chair assemblies 18. A chair usage beacon 60 is electrically coupled to the seat usage sensor 58 and transmits a wireless distress signal when the seat usage sensor 58 detects weight on a seat 26 of one of the chair assemblies 18 associated with the seat usage sensor 58. Each of the chair assemblies 18 may include a seat usage sensor 58 electrically coupled to the chair usage beacon 60. The capsized beacon 52, seat deployment beacon 56 and the seat usage beacon 60 may each be electrically coupled to a global positioning system 62 to transmit the coordinates of the boat 12 along with the distress signal.

In use, the boat 12 is used in a conventional manner. However, should the boat 12 capsize, the chair assemblies 18 may be utilized by persons to sit upon the boat hull 14 until rescue personnel arrive. Since a capsized boat can float for a long duration of time, the chair assemblies 18 may provide an area of safety for the persons to be rescued while the various beacons transmit their location.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An emergency seating system comprising:

a boat having a hull having a bottom side; and a plurality of chair assemblies, each of said chair members being embedded into said bottom side, each of said chair assemblies being positionable in a stored position being approximately flush with said bottom side or in a deployed position extending outwardly away from said bottom side, wherein each of said chair assemblies includes;

a chamber extending into said bottom side, said chamber including a bottom wall and a perimeter wall being attached to and extending between said bottom wall and said bottom side of said hull;

a seat being mounted to said chamber, said seat having an upper side, a lower side, a front edge and a back edge;

a backrest being pivotally coupled to said seat adjacent to said back edge, said backrest being foldable into said stored position lying on and abutting said upper side or into said deployed position extending upwardly from said seat.

2. The system according to claim 1, wherein a juncture of said front edge and said lower side is hingedly coupled to said hull at a juncture of said perimeter wall and said bottom side to allow said seat to be pivoted onto said bottom side of said hull such that said upper side faces upwardly.

3. The system according to claim 2, further including said lower side comprising a cover covering said chamber when said seat is pivoted into said chamber, a gasket engaging said cover to inhibit water flow into said chamber.

4. The system according to claim 1, further including a plurality of seat straps, each of said chair assemblies having one of said seat straps attached thereto and being configured to secure a person to associated ones of said chair assemblies.

5. The system according to claim 1, further including a capsized sensor being mounted in said boat, said capsized sensor detecting an orientation of said boat hull, a capsized beacon being electrically coupled to said capsized sensor, said capsized beacon wirelessly transmitting a distress signal when said capsized sensor detects said bottom side facing upwardly.

6. The system according to claim 1, further including a seat deployment sensor being mounted in one of said chair assemblies, a seat deployment beacon being electrically coupled to said seat deployment sensor and transmitting a wireless distress signal when said seat deployment sensor detects deployment of one of said chair assemblies associated with said seat deployment sensor.

7. The system according to claim 1, further including a seat usage sensor being mounted in one of said chair assemblies, a chair usage beacon being electrically coupled to said seat usage sensor and transmitting a wireless distress signal when said seat usage sensor detects weight on a seat of one of said chair assemblies associated with said seat usage sensor.

8. An emergency seating system comprising:

a boat having a hull having a bottom side;

a plurality of chair assemblies, each of said chair members being embedded into said bottom side, each of said chair assemblies being positionable in a stored position being approximately flush with said bottom side or in a deployed position extending outwardly away from said bottom side, each of said chair assemblies including;

a chamber extending into said bottom side, said chamber including a bottom wall and a perimeter wall being attached to and extending between said bottom wall and said bottom side of said hull;

a seat being mounted to said hull, said seat having an upper side, a lower side, a front edge and a back edge, a juncture of said front edge and said lower side being hingedly coupled to said hull at a juncture of said perimeter wall and said bottom side to allow said seat to be pivoted onto said bottom side of said hull such that said upper side faces upwardly;

a backrest being pivotally coupled to said seat adjacent to said back edge, said backrest being foldable into said stored position lying on and abutting said upper side or into said deployed position extending upwardly from said seat;

said lower side comprising a cover covering said chamber when said seat is pivoted into said chamber, a gasket engaging said cover to inhibit water flow into said chamber;

a plurality of seat straps, each of said chair assemblies having one of said seat straps attached thereto and being configured to secure a person to associated ones of said chair assemblies;

a capsized sensor being mounted in said boat, said capsized sensor detecting an orientation of said boat hull, a capsized beacon being electrically coupled to said capsized sensor, said capsized beacon wirelessly transmitting a distress signal when said capsized sensor detects said bottom side facing upwardly;

a seat deployment sensor being mounted in one of said chair assemblies, a seat deployment beacon being electrically coupled to said seat deployment sensor and transmitting a wireless distress signal when said seat deployment sensor detects deployment of one of said chair assemblies associated with said seat deployment sensor; and a seat usage sensor being mounted in one of said chair assemblies, a chair usage beacon being electrically coupled to said seat usage sensor and transmitting a wireless distress signal when said seat usage sensor detects weight on a seat of one of said chair assemblies associated with said seat usage sensor.

9. An emergency seating system comprising:

a boat having a hull having a bottom side;

a plurality of chair assemblies, each of said chair members being embedded into said bottom side, each of said chair assemblies being positionable in a stored position being approximately flush with said bottom side or in a deployed position extending outwardly away from said bottom side; and a seat deployment sensor being mounted in one of said chair assemblies, a seat deployment beacon being electrically coupled to said seat deployment sensor and transmitting a wireless distress signal when said seat deployment sensor detects deployment of one of said chair assemblies associated with said seat deployment sensor.

10. The system according to claim 9, further including a plurality of seat straps, each of said chair assemblies having one of said seat straps attached thereto and being configured to secure a person to associated ones of said chair assemblies.

11. The system according to claim 9, further including a capsized sensor being mounted in said boat, said capsized sensor detecting an orientation of said boat hull, a capsized beacon being electrically coupled to said capsized sensor, said capsized beacon wirelessly transmitting a distress signal when said capsized sensor detects said bottom side facing upwardly.

12. The system according to claim 9, further including a seat usage sensor being mounted in one of said chair assemblies, a chair usage beacon being electrically coupled to said seat usage sensor and transmitting a wireless distress signal when said seat usage sensor detects weight on a seat of one of said chair assemblies associated with said seat usage sensor.

* * * * *